US012378677B2

(12) United States Patent
Gold et al.

(10) Patent No.: US 12,378,677 B2
(45) Date of Patent: Aug. 5, 2025

(54) MULTI-COMPONENT DEPOSITS

(71) Applicants: Rolls-Royce Corporation, Indianapolis, IN (US); Rolls-Royce North American Technologies, Inc., Indianapolis, IN (US)

(72) Inventors: Matthew R. Gold, Indianapolis, IN (US); Peter Joseph Loftus, Indianapolis, IN (US)

(73) Assignees: Rolls-Royce Corporation, Indianapolis, IN (US); Rolls-Royce North American Technologies, Inc., Indianapolis, IN (US)

( * ) Notice: Subject to any disclaimer, the term of this patent is extended or adjusted under 35 U.S.C. 154(b) by 191 days.

(21) Appl. No.: 17/657,884

(22) Filed: Apr. 4, 2022

(65) Prior Publication Data

US 2022/0228267 A1 Jul. 21, 2022

Related U.S. Application Data

(62) Division of application No. 16/657,854, filed on Oct. 18, 2019, now abandoned.

(51) Int. Cl.
*C23C 24/04* (2006.01)
*B22F 1/142* (2022.01)
(Continued)

(52) U.S. Cl.
CPC ..... *C23C 24/04* (2013.01); *B22F 1/142* (2022.01); *B22F 7/04* (2013.01); *C23C 30/005* (2013.01);
(Continued)

(58) Field of Classification Search
CPC ..... C23C 24/04; C23C 24/085; C23C 24/087; B22F 1/142; B22F 2303/20; B22F 2303/30; B22F 2301/00
(Continued)

(56) References Cited

U.S. PATENT DOCUMENTS 3,410,732 A 11/1968 Smith
6,250,362 B1 * 6/2001 Rioja ..... C23C 4/123 164/79
(Continued)

FOREIGN PATENT DOCUMENTS

CA 2695764 A1 4/2009
EP 2604723 A1 6/2013
(Continued)

OTHER PUBLICATIONS

"Standard Test Methods for Tension Testing of Metallic Materials", Designation E8/E8M-16a, Published online Sep. 2016, 30 pgs.
(Continued)

*Primary Examiner* — Brian K Talbot
(74) *Attorney, Agent, or Firm* — Shumaker & Sieffert, P.A.

(57) ABSTRACT

The disclosure describes an example technique that includes cold spraying first particles and second particles of a metal alloy on at least a portion of a surface of a substrate to form a deposit on the surface of the substrate. The first and second particles have been subjected to different heat treatments prior to cold spraying. Cold spraying involves accelerating the first particles and the second particles toward the surface of the substrate without melting or creating other thermally induced changes to a microstructure of the first and second particles. As a result, the first particles form a first, heat-treated component and the second particles form a second non-heat-treated or differently-heat-treated component, and the particles and substrate are not subject to a heat treatment during the cold spray process that may further modify their thermomechanical properties.

18 Claims, 3 Drawing Sheets

(51) Int. Cl.
*B22F 7/04* (2006.01)
*C23C 30/00* (2006.01)

(52) U.S. Cl.
CPC ... *B22F 2007/042* (2013.01); *B22F 2301/052* (2013.01); *B22F 2301/10* (2013.01); *B22F 2301/15* (2013.01); *B22F 2301/205* (2013.01); *B22F 2301/35* (2013.01); *B22F 2303/20* (2013.01); *B22F 2303/30* (2013.01); *B22F 2304/10* (2013.01); *B22F 2999/00* (2013.01)

(58) Field of Classification Search
USPC ..... 427/180, 455
See application file for complete search history.

(56) References Cited

U.S. PATENT DOCUMENTS

| | | | | |
|---|---|---|---|---|
| 11,148,195 | B2 * | 10/2021 | Izawa | C22C 1/04 |
| 2007/0144621 | A1 | 6/2007 | Farmer et al. | |
| 2009/0263268 | A1 * | 10/2009 | Kondoh | B22F 1/142 419/41 |
| 2010/0189995 | A1 * | 7/2010 | Adams | C23C 4/06 428/323 |
| 2017/0226614 | A1 * | 8/2017 | Bellon | C22C 30/02 |
| 2019/0001427 | A1 * | 1/2019 | Shuck | B23K 1/0018 |
| 2019/0009300 | A1 * | 1/2019 | Mahalingam | B05D 7/14 |
| 2019/0329906 | A1 * | 10/2019 | Cawthorne | B64C 11/205 |
| 2019/0368049 | A1 * | 12/2019 | Izawa | B22F 1/00 |
| 2021/0017651 | A1 * | 1/2021 | Pezzutti | C23C 24/04 |
| 2021/0071305 | A1 * | 3/2021 | Peters | C22F 1/183 |
| 2021/0115566 | A1 | 4/2021 | Gold et al. | |
| 2021/0370587 | A1 * | 12/2021 | Camilleri | B22F 3/1035 |
| 2022/0042177 | A1 * | 2/2022 | Shibayama | B22F 5/008 |
| 2022/0154345 | A1 * | 5/2022 | Kamada | F01L 3/04 |

FOREIGN PATENT DOCUMENTS

| | | | |
|---|---|---|---|
| JP | 2012077339 | A | 4/2012 |
| WO | 0120534 | A1 | 3/2001 |
| WO | 2017220996 | A1 | 12/2017 |
| WO | 2019016779 | A1 | 1/2019 |

OTHER PUBLICATIONS

Extended European Search Report from counterpart EP Application No. 20196840.1 dated Mar. 15, 2021, 7 pgs.
Handbook, A. S. M. "vol. 148 Metalworking: sheet forming." ASM International 924 (2006) (Year: 2006) (Applicant points out, in accordance with MPEP 609.04(a), that the year of publication, 2006, is sufficiently earlier than the effective U.S. filing date, so that the particular month of publication is not in issue.)
Huang et al., "The Effects of heat treatment on the mechanical properties of cold-sprayed coatings", Available online Nov. 14, 2014, Surface & Coatings Technology 261 (2015) 278-288, 11 pgs.
JP-2012077339-A English language translation (Year: 2012).
Moridi et al., Cold spray coating: review of materials systems and future perspectives, Mar. 2014, Surface Enginering 2014, vol. 36, No. 6, 27 pgs.
Murray et al., Heat Treatment of Cold-Sprayed C355 A1 for Repair: Microstructure and Mechanical Properties, Available online Nov. 22, 2017, J Therm Spray Tech (2018) 27:159-168, 10 pgs.
Ning et al., "Characteristics and heat treatment of cold-sprayed Al—Sn binary alloy coatings", Available online Oct. 31, 2008, Applied Surface Science 255 (2009) 3933-3939, 7 pgs.
Notice of Intent to Grant and Text Intended to Grant from counterpart European Application No. 20196840.1, dated Oct. 27, 2021, 47 pp.
Prosecution History from U.S. Appl. No. 16/657,854, dated Feb. 12, 2021 through Apr. 6, 2022, 95 pp.
Response to Extended Search Report dated Mar. 15, 2021, from counterpart European Application No. 20196840.1, filed Sep. 21, 2021, 60 pp.
Rokni et al., "The effects of heat treatment on 7075 A1 cold spray deposits", Available online Oct. 24, 2016, Surface & Coatings Technology 310 (2017) 278-285, 8 pgs.
Sabard et al. "Inter-particle bonding in cold spray deposition of a gas-atomised and a solution heat-treated AI 6061 powder," Jun. 12, 2019, 18 pgs.
Srinivasan, "Cold Spray Applications in Repair and Refurbishment for the Aerospace, Oil and Gas, and Power-Generation Industries", High Pressure Cold Spray Principles and Applications—Chapter 11, 2016, 29 pgs. (Applicant points out, in accordance with MPEP 609.04(a), that the year of publication, 2016, is sufficiently earlier than the effective U.S. filing date, so that the particular month of publication is not in issue.).
Notice of Intent to Grant from counterpart Singapore Application No. 10202009705S dated Dec. 5, 2023, 4 pp.

* cited by examiner

MULTI-COMPONENT DEPOSITS

This application is a divisional of U.S. application Ser. No. 16/657,854, filed Oct. 18, 2019, which is incorporated herein by reference in its entirety.

TECHNICAL FIELD

The disclosure relates to multi-component deposits and techniques for forming multi-component deposits.

BACKGROUND

Heat treatment processes may be used to alter the physical properties of a component, such as a mechanical part, after the component has been formed. In a typical heat treatment process, a fabricated component may be heated to a predefined bulk temperature, such as a transformation temperature of the constituent material of the component, held at the temperature for a period of time to achieve a relatively uniform temperature throughout the component, and cooled at a predefined cooling rate to achieve a particular transformation of the constituent material of the component. As a result, the component may include a relatively uniform set of physical properties different from the initial set of physical properties of the component prior to heat treatment.

SUMMARY

The disclosure describes example articles, and techniques and systems for forming the example articles, that include a deposit having a heat-treated component and either a non-heat-treated or a differently-heat-treated component.

In some examples, the disclosure describes an example technique that includes cold spraying first particles and second particles of a metal alloy on at least a portion of a surface of a substrate to form a deposit on the surface of the substrate. The first and second particles have been subjected to different heat treatments prior to cold spraying. For example, the first particles may include particles that have undergone a heat treatment, while the second particles may include particles that have either undergone no heat treatment or undergone a different heat treatment than the first particles. Cold spraying involves accelerating the first particles and the second particles toward the surface of the substrate without melting or creating other thermally induced changes to a microstructure of the first and second particles. As a result, the first particles form a first, heat-treated component and the second particles form a second non-heat-treated or differently-heat-treated component, and the particles and substrate are not subject to a heat treatment during the cold spray process that may further modify their thermomechanical properties.

In some examples, the disclosure describes an example article that includes a substrate defining a surface and a deposit on the surface of the substrate in which the deposit was formed using cold spraying. The deposit includes a first component and a second component. Cold spraying involves accelerating first particles and second particles of a metal alloy toward the surface of the substrate without creating thermally induced changes to a microstructure of the respective first and second particles. The first and second particles have been subjected to different heat treatments prior to cold spraying.

The details of one or more examples are set forth in the accompanying drawings and the description below. Other features, objects, and advantages will be apparent from the description and drawings, and from the claims.

DETAILED DESCRIPTION

Figure 1A:
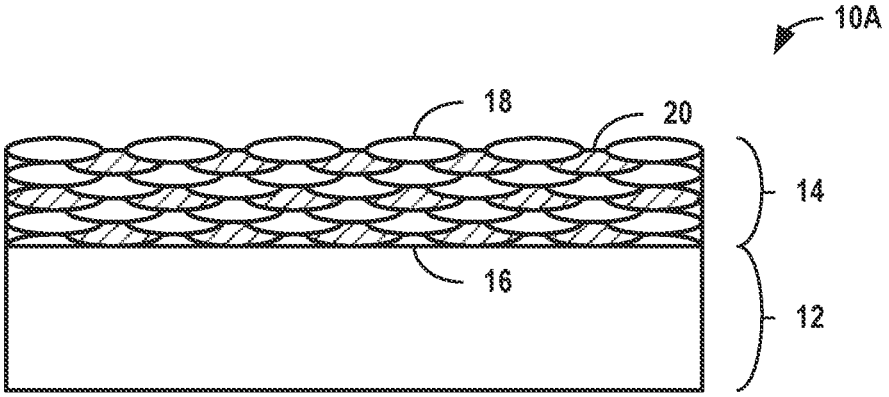
FIG. 1A is a conceptual cross-sectional view of an example article including a deposit that includes a first component and a second component.

The disclosure generally describes example systems and techniques for depositing heat treated metal alloys and, optionally, non-heat-treated metal alloys onto a substrate without exposing the substrate to high temperatures. The example techniques involve cold spraying metal alloy particles onto a substrate to form a deposit. These cold sprayed metal alloy particles include a mix of particles having a metal alloy that has been heat treated ("heat-treated particles") and particles having the same metal alloy that either has not been heat treated ("non-heat-treated particles") or has been heat treated with a different heat-treatment ("differently-heat-treated particles"). Heat-treated particles may have properties, such as tensile strength and elongation, that are improved compared to non-heat-treated particles of the same composition. In cold spraying, the heat-treated particles, non-heat-treated particles, and/or differently-heat-treated particles are directed toward and impact the substrate while having temperatures that remain below a temperature at which the particles experience thermally induced property changes. The cold sprayed particles bond with previously deposited particles to form a two-component deposit that includes a heat-treated component and either a non-heat-treated component or a differently-heat-treated component.

In some examples, the techniques discussed herein incorporate heat-treated materials into an article without exposing an underlying substrate of the article or materials in the deposit to temperature conditions experienced during heat treatment processes. For example, deposition of a heat-treated metal alloy layer may involve first depositing the metal alloy layer and subsequently exposing both the metal alloy layer and the substrate to heat treatment conditions, including high temperature conditions for extended periods of time and/or fast cooling conditions. These high temperature and/or fast cooling conditions may damage the substrate and/or produce undesired changes in properties of the substrate. Cold spray deposition of heat-treated particles may occur below the melting point or other transition temperature of the metal alloy and without bulk heating of the underlying substrate or deposited material, such that the underlying substrate or deposited material is exposed to lower temperatures than techniques that incorporate heat-treated materials onto a substrate without cold spraying. As such, properties of the heat-treated particles, non-heat-treated particles, and/or differently-heat-treated particles may be substantially unchanged after cold spraying.

In some examples, the techniques discussed herein incorporate a blend of various heat-treated materials and non-heat-treated materials into an article. For example, heat treatment of a metal alloy layer may involve bulk heating the metal alloy layer to a substantially uniform temperature to produce a metal alloy layer with substantially homogeneous properties. Cold spray deposition of the heat-treated particles and differently-heat-treated or non-heat-treated particles may produce a deposit that includes properties, such as tensile strength and elongation, derived from the heat-treated material, and either and the non-heat-treated material or the differently-heat-treated material, such that deposits formed from a mix of heat-treated particles and differently-heat-treated or non-heat-treated particles may include a greater variety of properties than deposits formed from heat-treated or non-heat-treated materials alone.

FIG. 1A is a conceptual cross-sectional view of an example article 10A that includes a substrate 12 and a deposit 14. In some examples, article 10A may be a component of a gas turbine engine. For example, article 10A may be a component with a barrier coating, a repaired component, a multi-layer component, or the like. Due to high temperatures experienced in gas turbine engine, components of gas turbine engines may incorporate heat treated materials to relieve residual stresses and increase desired properties. In some examples, substrate 12 includes a bulk material, such as a forged metal, a cast metal, or a sheet metal, that may be substantially homogeneous (e.g., homogeneous or nearly homogeneous to the extent possible by common metallurgy techniques). Bulk materials that may be used for substrate 12 include, but are not limited to, Ni-based alloys, Co-based alloys, Ti-based alloys, or Fe-based alloys. Substrate 12 defines a surface 16. Surface 16 may have a variety of surface conditions including, but not limited to, an as-manufactured surface, a damaged surface, or the like.

Deposit 14 is on at least a portion of surface 16 of substrate 12. While shown in FIG. 1A as covering an entirety of surface 16, in some instances, deposit 14 may only cover a particular area, such as a portion of article 10A that may experience abrasion, high temperatures, or other external phenomena that induce stresses and/or fractures. Deposit 14 may represent a one or more of a variety of functional deposits of the metal alloy on substrate 12 including, but not limited to: a structure functionally differentiated from substrate 12, such as a flange or other structure extending from and/or complementary to substrate 12; a repair joint of substrate 12, such as a filler; a coating on substrate 12, such as a barrier coating; a layer on substrate 12, such as a layer in a multi-layer part; or the like.

In some examples, deposit 14 may be configured to improve properties of substrate 12. For example, substrate 12 may be a damaged component having cracked surface 16 that includes one or more cracks that extend into substrate 12. Rather than replace substrate 12 with a new part or repair substrate 12 using high temperature techniques, such as welding or post-deposition heat treatment, deposit 14 may be formed within the one or more cracks to fill the cracks. As a result, substrate 12 may have improved properties, such as strength aerodynamic shape, or the like, compared to substrate 12 prior to receiving deposit 14. In some examples, deposit 14 and substrate 12 include the same composition, such that article 10A may have a substantially homogeneous composition after repair of substrate 12. In some examples, deposit 14 and substrate 12 may include different compositions. For example, a particular composition of deposit 14 may be better suited (e.g., more easily bond with substrate 12 using cold spraying, etc.) as a filler for cracks than a composition of substrate 12.

In some examples, deposit 14 may be configured to protect substrate 12 from physical impact or chemical reactants. For example, substrate 12 may be a high temperature component, such that portions of substrate 12 near surface 16 may face a high temperature environment with reducing agents, such as calcia-magnesia-alumina-sulfur (CMAS), that may damage substrate 12. To protect substrate 12 from these agents, deposit 14 may extend continuously across surface 16 to provide a dense, high strength barrier for substrate 12.

In some examples, deposit 14 may be configured to complement substrate 12 as a separate structure that provides additional functionality to substrate 12. For example, deposit 14 may include a mechanical component, such as a flange, that is mechanically coupled to substrate 12 and configured to perform a different function than substrate 12.

Deposit 14 includes a metal alloy. Metal alloys may have constituent elements that, when subjected to various heat treatments, undergo phase transformations or migrate from solution to change a microstructure of deposit 14. The metal alloy of deposit 14 may include any metal alloy whose properties may change, such as through changes in microstructure or homogeneity of the metal alloy, in response to heat treatment processes. Metal alloys that may be used include, but are not limited to, Mg-based alloys, Ni-based alloys, Ti-based alloys, Fe-based alloys, Al-based alloys, Co-based alloys, Ta-based alloys, Nb-based alloys, Zn-based alloys, Cr-based alloys, and Cu-based alloys.

Deposit 14 is deposited on surface 16 using cold spraying techniques. As will be explained further in FIG. 2 below, cold spraying involves accelerating first particles (e.g., heat-treated particles) and second particles (e.g., differently-heat-treated or non-heat-treated particles) of the metal alloy constituting at least a portion of deposit 14 toward surface 16 of substrate 12. Upon impacting surface 16 or a working surface of deposit 14, the first and second particles undergo deformation and bond to substrate 12 and/or previously deposited particles without melting. As a result of cold spray deposition of the first and second particles, deposit 14 may have a very dense microstructure and an interface with substrate 12 that is substantially free of voids, and may be characterized by grain boundaries and dislocation networks formed at interfaces of localized deposits corresponding to deposited first and second particles. Deposit 14 formed from the first and second particles may have the same or nearly the same microstructure as the first and second particles before spraying, i.e., there is no thermally induced microstructure change to the particles themselves. This may allow better control of the properties of the particles/domains/regions in the deposit compared to cases where melting occurs during spraying.

Deposit 14 includes a first component 18 (e.g., a heat-treated component) and a second component 20 (e.g., a differently-heat-treated or non-heat-treated component). While shown as visually differentiated elements (e.g., interfaces between deposits) in FIG. 1A to emphasize a relationship of first component 18 and second component 20 to first particles and second particles, respectively, it will be understood that deposits of heat-treated metal alloys corresponding to first component 18 and non-heat-treated or differently-heat-treated metal alloys corresponding to second component 20 may not be differentiated by clear physical boundaries due to bonding of the metal alloy deposits from the particles, and that portions of deposit 14 corresponding to first component 18 and second component 20 may be differentiated by any differences in properties derived from heat treatment processes of the metal alloy, as will be described further below.

First component 18 may include any portion of deposit 14 that includes a metal alloy that has undergone heat treatment prior to deposition on surface 16. Heat treatment may include any process that involves application of heat or cold to a bulk material to change properties of the bulk material. First component 18 may include a heat-treated metal alloy formed from a variety of heat treatments including, but not limited to, annealing, hardening (e.g., aging), surface hardening, and the like. Mechanical properties of first component 18 may depend on a composition of first component 18, a type of heat treatment previously applied to first component 18, and/or various parameters used to cold spray heat-treated particles of the metal alloy on surface 16.

Second component 20 may include any portion of deposit 14 that includes a metal alloy that has been subjected to a different heat treatment than first component 18, such as no heat treatment or another heat treatment. While second component 20 may have a same composition (i.e., same chemistry) as first component 18, second component 20 may have properties that are different from, and may be complementary to, first component 18. In some examples, second component 20 includes a metal alloy that has not undergone or been subjected to heat treatment. For example, second component 20 may include a metal alloy that has not undergone an amount (e.g., high enough temperature, long enough period of time) of bulk heating or cooling sufficient to cause a change in microstructure or homogeneity of the metal alloy. In some examples, second component 20 includes a metal alloy that has undergone or been subjected to a different heat treatment than first component 18. In some examples, the second component may include a heat-treated composition having a same chemistry and different heat treatment as first component 18. For example, second component 20 may include a metal alloy that has undergone a heat treatment that has caused different changes in microstructure or homogeneity of the metal alloy than the heat treatment of first component 18. Certain heat treatments directed toward creating more homogeneous microstructures, such as annealing, may complement heat-treatments directed toward precipitating constituents, such as hardening, such that deposit 14 may have a blend of properties that result from more than one heat-treatment. First component 18 may include a heat-treated metal alloy formed from a variety of heat treatments including, but not limited to, annealing, hardening (e.g., aging), surface hardening, and the like.

First component 18 and/or second component 20 may be selected for a variety of properties including, but not limited to, tensile strength, yield strength, hardness, toughness, percent elongation, percent reduction, Young's modulus, and the like. For example, the composition of the metal alloy of first component 18 and second component 20 and/or the heat treatment process corresponding to first component 18 may be selected for any properties of either of the heat-treated metal alloy and/or the non-heat-treated metal alloy. As one example in which deposit 14 is a barrier coating, first component 18 may be selected for high hardness. As another example in which deposit 14 is a repair joint, first component 18 may be selected for high ductility/elongation, high toughness, and/or high tensile strength. Properties of first component 18 and second component 20, such as tensile strength, elongation, and yield strength, may be measured using test methods such as, for example, ASTM E8 Standard Test Methods for Tension Testing of Metallic Materials, such as for samples that include first component 18 and/or second component 20, individually or as a blended cold-spray deposit.

In some examples, first component 18 includes a hardened metal alloy formed from a hardening process. For example, hardening may increase tensile strength and ductility (i.e., elongation) of the metal alloy, such that deposit 14 that includes first component 18 may have a greater toughness than deposits that do not include a hardened component; reduce hardness of the metal alloy; create a more stable metal alloy that may age less in service; and/or modify surface properties of the first particles that form first component 18, which may change behaviors of the metal alloy within the bulk of deposit 14. In some examples, first component 18 includes at least one of a precipitation hardened metal alloy, a quenched hardened metal alloy, or a tempered metal alloy. In some examples, a tensile strength of first component 18 is at least about twice as high as a tensile strength of second component 20, such as at least about 5 times higher. For example, hardened aluminum may have a tensile strength of about 20,000 PSI or higher, while non-hardened aluminum may have a tensile strength of about 4000 PSI. In some examples, a percent elongation of first component 18 is at least about 50% higher than a percent elongation of second component 20. For example, hardened aluminum may have a percent elongation of about 4-8%, while a non-hardened aluminum may have a percent elongation of about 2-4%.

As a result of incorporation of both first component 18 and second component 20, deposit 14 may have bulk properties derived from first component 18 and second component 20 that are different from properties of first component 18 or second component 20 individually. For example, while first component 18 may have improved properties such as tensile strength and ductility as compared to second component 20, first component 18 may have increased brittleness, which may increase susceptibility to cracking. However, second component 20 may moderate these properties, such that deposit 14 may have values of bulk properties that are between the individual properties of either first component 18 or second component 20. A volume ratio of first component 18 and second component 20 may be selected to achieve a particular set of properties derived from a relative volume of first component 18 and a volume of second component 20. In some examples, a volume percentage of first component 18 in deposit 14 is between about 1% and about 99%, such as between about 10% and about 90%, or between about 30% and about 70%.

First component 18 and second component 20 may be distributed throughout deposit 14 in various concentrations and distributions. For example, due to incremental deposition of first and second particles during cold spraying, distribution (e.g., parallel or normal to surface 16 of substrate 12) of first component 18 and second component 20 may be adjusted temporally and/or spatially. In some examples, first component 18 and second component 20 may be distributed substantially homogenously throughout deposit 14, such that deposit 14 may have relatively uniform bulk properties. In some examples, first component 18 and second component 20 may be non-homogeneously distributed throughout deposit 14, such that deposit 14 may have non-uniform bulk properties. For example, a concentration of first component 18 may be higher in a first portion of deposit 14, such as near surface 16, than a second portion of deposit 14 to provide properties that may be more suitable for the corresponding portion.

In some examples, in addition to incorporating the metal alloy of first component 18 and second component 20, deposit 14 may include other components that provide alternative or additional functionality to deposit 14. For example, deposit 14 may include the metal alloy as a first composition and may include another composition, such as another metal, metal alloy, or ceramic, as a third component. For example, the second composition may include various properties that complement first component 18 and/or second component 20.

Figure 1B:
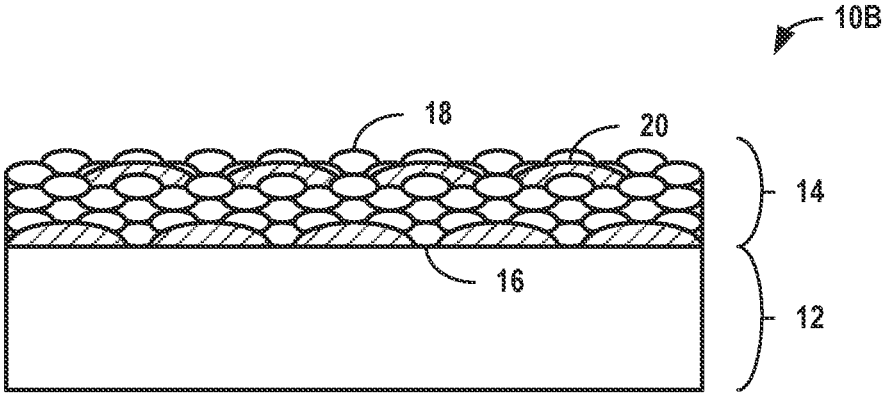
FIG. 1B is a conceptual cross-sectional view of an example article including a deposit that includes a first component and a second component.

In the example of FIG. 1A, regions of deposit 14 corresponding to first component 18 and second component 20 are illustrated as having a similar size. For example, a substantially uniform size may correspond to more uniform grain boundaries. However, in some examples, regions of deposit 14 corresponding to first component 18 and second component 20 may have different sizes. FIG. 1B is a conceptual cross-sectional view of an example article 10B including a deposit that includes a first component and a second component. As illustrated in FIG. 1B, deposits corresponding to first component 18 and second component 20 may have different sizes. Such different sized deposits of first component 18 and second component 20 may result from different sized first and second particles. In some instances, different size particles may change a behavior of deposit 14 under load. For example, without being limited to any particular theory, second component 20 may have smaller deposits of first component 18 at an interface of deposits of second component 20 and first component 18 boundary. These different sizes of the deposits may impact deformation at the boundaries when under load, such that the smaller deposits may lock the boundary and reduce deformation at the boundary.

Figure 2:
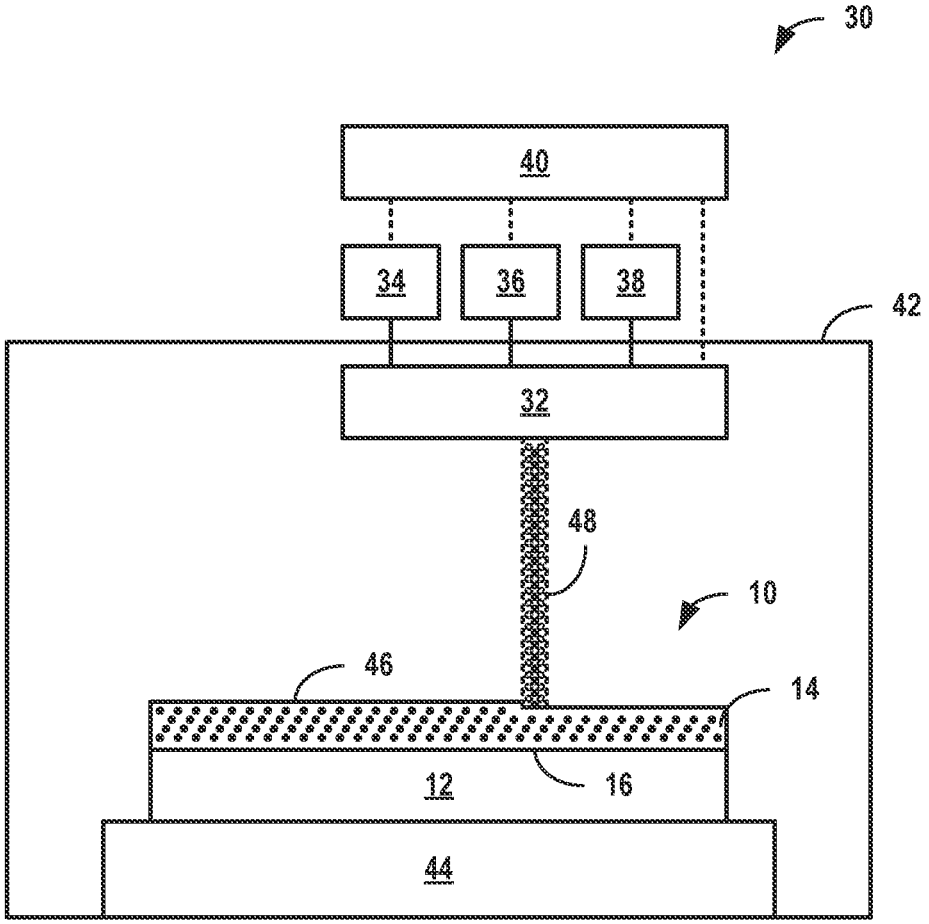
FIG. 2 is a conceptual and schematic block diagram of an example system for forming a deposit on a surface of a substrate by cold spraying first particles and second particles of a metal alloy on the surface of the substrate.

Articles described herein may be produced using cold spray deposition systems. FIG. 2 is a conceptual and schematic block diagram of an example system 30 for forming deposit 14 using cold spraying. System 30 is configured to form deposit 14 on substrate 12 by cold spraying first particles and second particles of a metal alloy on at least a portion of surface 16 of substrate 12. System 30 may include an enclosure 42, which encloses a stage 44, a cold spray gun 32, a first material source 34, a second material source 36, and a gas source 38. System 30 may further include a computing device 40, which is communicatively connected to stage 44, cold spray gun 32, first material source 34, second material source 36, and gas source 38.

Article 10 is positioned within enclosure 42. Enclosure 42 may substantially enclose (e.g., enclose or nearly enclose) stage 44, cold spray gun 32, first material feed 34, second material feed 36, gas source 38, and article 10. Enclosure 42 may maintain a desired atmosphere (e.g., an atmosphere that is substantially inert to the materials from which deposit 14 is formed) around substrate 12 and deposit 14 during the cold spray technique. In some examples, stage 44 may be configured to selectively position and restrain article 10 in place relative to stage 44 during formation of deposit 14. In some examples, stage 44 is movable relative to cold spray gun 32. For example, stage 44 may be translatable and/or rotatable along at least one axis to position article 10 relative to cold spray gun 32. Similarly, in some examples, cold spray gun 32 may be movable relative to stage 44 to position cold spray gun 32 relative to article 10. In some examples, system 30 may not include enclosure 42 and stage 44. For example, system 30 may include a portable device configured to cold spray the heat-treated and non-heat-treated metal alloy particles in situ, such as during a repair. In such examples, system 30 may include temporary containment as enclosure 42.

First material source 34 and second material source 36 may each be configured to supply first particles and second particles, respectively, to cold spray gun 32. Each material source 34 and 36 may include, for example, a hopper or other container containing first particles and second particles, respectively. In some examples, material sources 34 and 36 may each include a pneumatic hopper operatively coupled to gas source 38, such that gas source 38 enables material sources 34 and 36 to feed the first particles and second particles, respectively, to cold spray gun 32. Computing device 40 may be communicatively coupled to first material source 34 and second material source 36 to control a rate of flow of first particles and second particles, respectively, from material sources 34 and 36 to cold spray gun 32 via a material feed. For example, computing device 40 may control a valve or a feeder system of the material feed. In addition to first material source 34 and second material source 36, system 30 may include other material sources, such as for a second composition. While shown as separate equipment, in some examples, first material source 34 and second material source 36 may be the same equipment. For example, first particles and second particles may be premixed prior to being fed into cold spray gun 32.

The first particles and second particles may have properties corresponding to localized properties of first component 18 and second component 20, respectively, of deposit 14, as described in FIG. 1A above. For example, the first particles may be selected to provide deposit 14 with particular properties resulting from a particular heat treatment including, but not limited to, tensile strength, yield strength, hardness, toughness, percent elongation, percent reduction, Young's modulus, and the like. In some examples, the first particles include at least one of a precipitation hardened metal alloy, a quenched hardened metal alloy, or a tempered metal alloy. In some examples, a tensile strength of the first particles is at least about 10% greater than a tensile strength of the second particles. In some examples, a percent elongation of the first particles is at least about 10% greater than a percent elongation of the second particles.

The first particles and second particles may include any suitable particle size. For example, the size range of the first and second particles may be between about 1 micrometer (μm) and about 50 μm, such as between about 5 μm and about 20 μm. The size range of the first and second particles may be selected to achieve a selected impact velocity, e.g., a velocity of the particles when impacting surface 16. In some examples, an average size of the first particles and the second particles may be different.

Gas source 38 may be configured to accelerate the first and second particles from first material source 34 and second material source 36, respectively. Gas source 38 may include, for example, a source of helium, nitrogen, argon, or other substantially inert gas, which may function as carrier of the particles. Gas source 38 may be fluidically coupled to a gas feed, which may control a flow rate and/or pressure of gas delivered to cold spray gun 32. In some examples, the gas feed may include a heater to heat the gas. The pressure of the gas in gas source 38 may be sufficient to achieve supersonic velocities of the gas and/or particles at the outlet of a nozzle. In some examples, the pressure of the gas may be between about 0.1 megapascals (MPa) and about 2 MPa, such as between about 0.5 MPa and about 1.5 MPa. In some examples, the supersonic velocities may be between about 500 meters per second (m/s) to about 1000 m/s.

Cold spray gun 32 may be configured to entrain the first particles from first material source 34 and the second particles from second material source 36 in the flow of gas from gas source 38 through a nozzle. The nozzle may accelerate the gas and plurality of particles to high velocities. The resultant high velocity particle stream 48 may be directed toward surface 16 of substrate 12. Without limiting the description to a specific theory, the high velocity of the plurality of particles may be sufficient to cause plastic deformation of the particles upon impact with surface 16 of substrate 12. This process may be repeated as particles attach to surface 16 and/or other attached particles defining a build surface 46 of deposit 14.

System 30 may be configured to control relative movement of high velocity particle stream 48 with respect to surface 16 of substrate 12 and/or build surface 46. For example, directing high velocity particle stream 48 toward substrate 12 may result in deposition of the plurality of particles on surface 16 of substrate 12 and/or build surface 46. As illustrated in FIG. 2, the first particles and the second particles may accumulate to form deposit 14. For example, high velocity particle stream 48 may be moved over surface 16 and/or build surface 46 until a sufficient amount of the heat-treated metal alloy and the non-heat-treated metal alloy has accumulated to define, at least roughly, deposit 14. For example, excess metal alloy may be deposited to form a structure with larger dimensions than a final structure of deposit 14, then excess metal alloy may be machined away to define deposit 14. Although not illustrated in FIG. 2, system 30 may also include a milling device or machining device configured to remove deposited metal alloy to define a final shape of deposit 14.

Computing device 40 may include, for example, a desktop computer, a laptop computer, a tablet, a workstation, a server, a mainframe, a cloud computing system, or the like. Computing device 40 may include or may be one or more processors or processing circuitry, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some examples, the functionality of computing device 40 may be provided within dedicated hardware and/or software modules.

Computing device 40 is configured to control operation of system 30, including, for example, stage 44, cold spray gun 32, material sources 34 and 36, and/or gas source 38. Computing device 40 may be configured to control operation of stage 44 and/or cold spray gun 32 to position article 10 relative to cold spray gun 32. For example, as described above, computing device 40 may control stage 44 and/or cold spray gun 32 to translate and/or rotate along at least one axis to position article 10 relative to cold spray gun 32.

Computing device 40 may control at least one of the feed rate of the first particles from first material source 34, second particles from second material source 36, pressure from gas source 38, flow rate of the gas from gas source 38, the movement of high velocity particle stream 48 relative to article 10, a distance between cold spray gun 32 and build surface 46, the angle of the high velocity particle stream relative to build surface 46, and a width of overlap between adjacent passes of the high velocity particle stream and the velocity of cold spray gun 32 relative to build surface 46. Computing device 40 may control at least one of these parameters to control an amount of material, such as heat-treated metal alloy and non-heat-treated metal alloy, added to article 10 at a given time and location and/or to control metallurgical properties of the added material. In some examples, cold spray gun 32 may be scanned (e.g., translated) relative to deposit 14, and deposit 14 will include a general shape corresponding to the scanned path.

Figure 3:
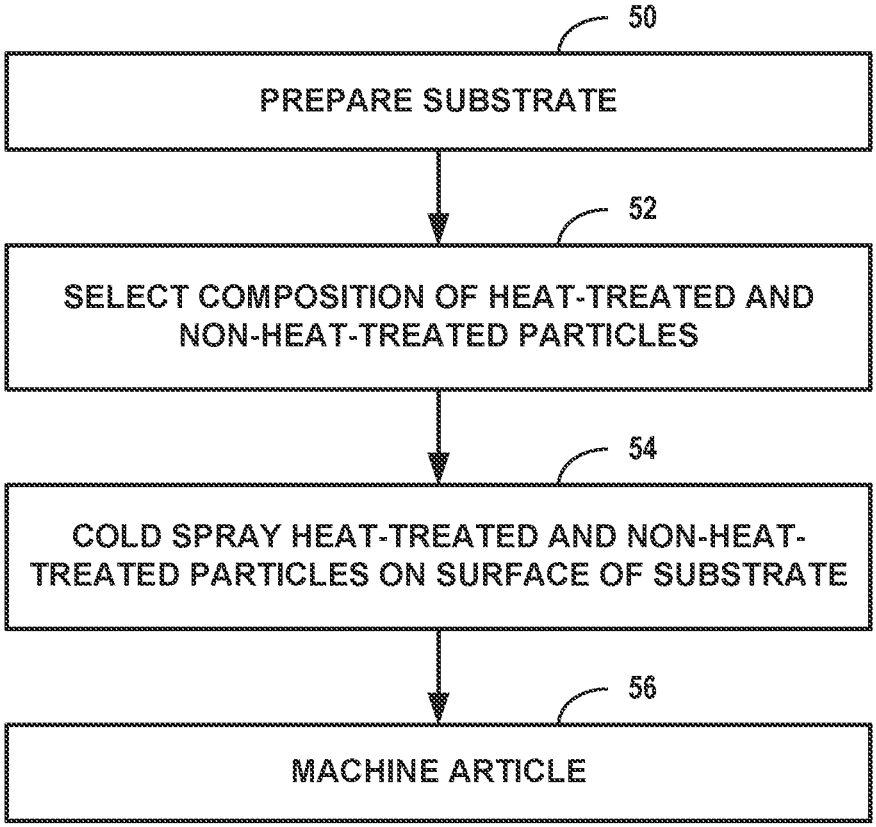
FIG. 3 is a flow diagram illustrating an example technique for forming a deposit on a surface of a substrate by cold spraying first particles and second particles of a metal alloy on the surface of the substrate.

The articles described herein may be formed using any suitable technique. FIG. 3 is a flow diagram illustrating an example technique for forming deposit 14 on surface 16 of substrate 12 that includes cold spraying first particles and second particles of a metal alloy. The technique of FIG. 3 will be described with concurrent reference to article 10 of FIG. 1A and system 30 of FIG. 2. In other examples, other systems may be used to perform the technique of FIG. 3, the technique of FIG. 3 may be used to form other composite components, or both.

In some examples, the technique illustrated in FIG. 3 may optionally include preparing substrate 12 (50). Preparing substrate 12 may include any process or series of processes to prepare surface 16 of substrate 12 for deposition of deposit 14. In some examples, preparing substrate 12 may include forming substrate 12. For example, forming substrate 12 may include forging, casting, or performing other metallurgy techniques to define a shape of substrate 12. In some examples, preparing substrate 12 may include surface preparation of surface 16, such as, for example, abrading surface 16 and/or coating surface 16 with a coating configured to improve bonding of deposit 14 or to improve mechanical properties or chemical properties of article 10, such as one or more thermal barrier coatings or environmental barrier coatings. In some examples, preparing substrate 12 may include treatment of a crack, chip, discontinuity, or other damaged feature for repair by deposit 14. For example, one or more surfaces of a crack may be smoothed, roughened, or otherwise treated to improve deposition or bonding of deposit 14 to the surface of the crack.

In some examples, the technique illustrated in FIG. 3 may optionally include selecting, by system 30, a composition of heat-treated particles and non-heat-treated particles (52). The composition of first particles and second particles in high velocity particle stream 48 may include a relative composition (e.g., a ratio) of the first and second particles. In some examples, computing device 40 may hold constant the composition of the first particles and second particles throughout the cold spray deposition process, such as for a deposit having substantially homogenous properties, while in other examples, computing device 40 may vary the composition of the first particles and the second particles during the cold spray deposition process, such as for a deposit having a spatially varying composition. For example, computing device 40 may receive, such as from a user input, a desired composition of deposit 14. The desired composition may represent a relative composition of first component 18, second component 20, and/or any other composition in resulting article 10.

The technique illustrated in FIG. 3 includes cold spraying, by system 30, heat-treated particles and non-heat-treated particles on to at least a portion of surface 16 of substrate 12 (54). As discussed above in reference to FIG. 1A, cold spraying involves using cold spray gun 32 and gas source 38 to accelerate first particles from first material source 34 and second particles from second material source 36 toward surface 16 of substrate 12 without melting the first and second particles. The first and second particles may contact surface 16 at velocities sufficient to cause plastic deformation of the particles and result in attachment or bonding of the particles to surface 16 and/or other attached particles defining build surface 46. In some examples, cold spraying includes high pressure cold spraying. For example, gas source 38 and material sources 34 and 36 may include pressurization systems to pressurize each of gases, first particles, and second particles.

In some examples, the technique illustrated in FIG. 3 may optionally include, after cold spraying the first and second particles to form first component 18 and second component 20, machining the deposited first component 18 and second component 20 to define deposit 14 (56). For example, forming deposit 14 may include cold spraying excess first component 18 and second component 20 on to surface 16, then machining away the excess first component 18 and second component 20. Machining away the excess first component 18 and second component 20 may enable system 30 to form deposit 14 including more complex geometries, with increased precision (e.g., within predetermined tolerances), or both compared to a technique without machining.

Various examples have been described. These and other examples are within the scope of the following claims.

What is claimed is:

1. A method comprising:

cold spraying first particles and second particles of a same metal alloy on at least a portion of a surface of a substrate to form a deposit on the surface of the substrate, wherein the first particles form a first component of the deposit and the second particles form a second component of the deposit, wherein cold spraying comprises accelerating the first particles and the second particles toward the surface of the substrate at a temperature below a melting point and a transition temperature without melting and without creating other thermally induced changes to a microstructure of the respective first and second particles, wherein the first and second particles have been subjected to different heat treatments prior to cold spraying, wherein the first component and the second component are non-homogeneously distributed throughout the deposit, wherein a tensile strength of the first particles is at least about 10% greater than a tensile strength of the second particles, and wherein a percent elongation of the first particles is at least about 10% greater than a percent elongation of the second particles.

2. The method of claim 1, wherein the first particles comprise at least one of precipitation hardened particles, quenched hardened particles, or tempered particles.

3. The method of claim 1, wherein a volume percentage of the first component in the deposit is between about 1% and about 99%.

4. The method of claim 1, wherein the metal alloy comprises at least one of a Mg-based alloy, a Ni-based alloy, a Ti-based alloy, a Fe-based alloy, an Al-based alloy, a Co-based alloy, a Ta-based alloy, a Nb-based alloy, a Zn-based alloy, a Cr-based alloy, or a Cu-based alloy.

5. The method of claim 1, wherein the surface comprises a cracked surface, and wherein forming the deposit further comprises filling the cracked surface with the deposit.

6. The method of claim 1, wherein a tensile strength of the first particles is at least about twice as high as a tensile strength of the second particles.

7. The method of claim 1, wherein an elongation of the first particles is at least about 50% greater than an elongation of the second particles.

8. The method of claim 1, wherein the metal alloy comprises a first composition, and wherein the method further comprises forming the substrate from a second composition, different from the first composition.

9. The method of claim 1, wherein the first and second particles and the substrate are not subject to a heat treatment during the cold spraying that would further modify thermomechanical properties of the first and second particles and the substrate.

10. The method of claim 8, wherein the second composition comprises the metal alloy that has not been subjected to a heat treatment prior to cold spraying.

11. The method of claim 1, wherein each of the first component and the second component of the deposit is characterized by grain boundaries and dislocation networks formed at interfaces of localized deposits corresponding to deposited respective first and second particles.

12. The method of claim 1, wherein the first particles comprise hardened particles subjected to a hardening heat treatment, and wherein the second particles comprise annealed particles subjected to an annealing heat treatment.

13. The method of claim 1, wherein the first component has a first microstructure and the second component has a second microstructure, different from the first microstructure.

14. The method of claim 1, wherein the second particles have either been subjected to a different heat treatment than the first particles prior to cold spraying, or not been subjected to heat treatment prior to cold spraying.

15. The method of claim 1, wherein the substrate comprises a component of a gas turbine engine.

16. The method of claim 15, wherein the deposit comprises at least one of a barrier coating or a repair joint.

17. The method of claim 1, wherein the first component and the second component are non-homogeneously distributed throughout the deposit in a direction between a surface of the deposit and a bulk of the deposit.

18. The method of claim 1, wherein an average size of the first particles is different from an average size of the second particles.

* * * * *